US006968911B2

(12) United States Patent
Moyes

(10) Patent No.: US 6,968,911 B2
(45) Date of Patent: Nov. 29, 2005

(54) APPARATUS AND METHODS FOR DRILLING

(75) Inventor: Peter Barnes Moyes, Aberdeen (GB)

(73) Assignee: Weatherford/Lamb, Inc., Houston, TX (US)

( * ) Notice: Subject to any disclaimer, the term of this patent is extended or adjusted under 35 U.S.C. 154(b) by 0 days.

(21) Appl. No.: 10/822,530

(22) Filed: Apr. 12, 2004

(65) Prior Publication Data

US 2004/0188145 A1 Sep. 30, 2004

Related U.S. Application Data

(63) Continuation of application No. 09/914,338, filed as application No. PCT/GB00/00642 on Feb. 25, 2000, now Pat. No. 6,719,071.

(30) Foreign Application Priority Data

Feb. 25, 1999 (GB) ..... 9904380

(51) Int. Cl.[7] ..... E21B 44/00
(52) U.S. Cl. ..... 175/65; 175/25
(58) Field of Search ..... 175/65, 25, 48, 175/57, 214, 217

(56) References Cited

U.S. PATENT DOCUMENTS

| | | | |
|---|---|---|---|
| 1,892,217 | A | 12/1932 | Molneau |
| 2,894,585 | A | 7/1959 | Erwin |
| 3,583,500 | A | 6/1971 | Randall, et al. |
| 4,049,066 | A | 9/1977 | Richey |
| 4,063,602 | A | 12/1977 | Howell et al. |
| 4,291,772 | A | 9/1981 | Beynet |
| 4,368,787 | A | 1/1983 | Messenger |
| 4,430,892 | A | 2/1984 | Owings |
| 4,479,558 | A | 10/1984 | Gill et al. |
| 4,534,426 | A | 8/1985 | Hooper |
| 4,583,603 | A | 4/1986 | Dorleans et al. |
| 4,630,691 | A | 12/1986 | Hooper |
| 4,744,426 | A | 5/1988 | Reed |
| 4,813,495 | A | 3/1989 | Leach |
| 5,339,899 | A | 8/1994 | Ravi et al. |
| 5,355,967 | A | 10/1994 | Mueller et al. |
| 5,651,420 | A | 7/1997 | Tibbitts et al. |

(Continued)

FOREIGN PATENT DOCUMENTS

| | | |
|---|---|---|
| WO | WO 00/04269 | 1/2000 |

(Continued)

OTHER PUBLICATIONS

Forrest, et al., "Subsea Equipment for Deep Water Drilling Using Dual Gradient Mud System," SPE/IADC Drilling Conference, Amsterdam, The Netherlands, Feb. 27, 2001-Mar. 1, 2001, 8 Pages.

(Continued)

*Primary Examiner*—Frank S. Tsay
(74) *Attorney, Agent, or Firm*—Moser, Patterson & Sheridan, L.L.P.

(57) ABSTRACT

A drilling method in which a rotary drill bit is mounted on a tubular drillstring extending through a bore comprises: drilling through a formation containing fluid at a predetermined pressure; circulating drilling fluid down through the drill string to exit the string at or adjacent the bit, and then upwards through an annulus between the string and bore wall; and adding energy to the drilling fluid in the annulus at a location above the formation. The addition of energy to the fluid in the annulus has the effect that the pressure of the drilling fluid above the formation may be higher than the pressure of the drilling fluid in communication with the formation and that predetermined differential may be created between the pressure of the formation fluid and the pressure of the drilling fluid in communication with the formation.

22 Claims, 4 Drawing Sheets

U.S. PATENT DOCUMENTS

| | | | |
|---|---|---|---|
| 5,720,356 | A | 2/1998 | Gardes |
| 6,065,550 | A | 5/2000 | Gardes |
| 6,257,333 | B1 | 7/2001 | Mann et al. |
| 6,837,313 | B2 | 1/2005 | Hosie et al. |
| 2005/0045382 | A1 | 3/2005 | Hosie et al. |

FOREIGN PATENT DOCUMENTS

| | | |
|---|---|---|
| WO | WO 00/08293 | 2/2000 |
| WO | WO00/50731 | 8/2000 |
| WO | WO 02/14649 | 2/2002 |
| WO | WO 03/023182 | 3/2003 |
| WO | WO 03/025336 | 3/2003 |

OTHER PUBLICATIONS

PCT International Search Report, International Application No. PCT/US 03/16686, dated Aug. 21, 2003 (WO 03/100208 A1).

APPARATUS AND METHODS FOR DRILLING

CROSS-REFERENCE TO RELATED APPLICATIONS

This application is a continuation of U.S. Ser. No. 09/914,338, filed Jan. 8, 2002, now U.S. Pat. No. 6,719,071, which is the National Stage of International Application No. PCT/GB00/00642, filed on Feb. 25, 2000, and published under PCT Article 21(2) in English, and claims priority of United Kingdom Application No. 9904380.4 filed on Feb. 25, 1999. The aforementioned applications are herein incorporated by reference in their entirety.

BACKGROUND OF THE INVENTION

1. Field of the Invention

The present invention relates to a drilling method, and to a drilling apparatus. Embodiments of the invention relate to a drilling method and apparatus where the effective circulating density (ECD) of drilling fluid (or drilling "mud") in communication with a hydrocarbon-bearing formation is lower than would be the case in a conventional drilling operation. The invention also relates to an apparatus for reducing the buildup of drill cuttings or other solids in a borehole during a drilling operation; and to a method of performing underbalance drilling.

2. Description of the Related Art

When drilling boreholes for hydrocarbon extraction, it is common practice to circulate drilling fluid or "mud" downhole: drilling mud is pumped from the surface down a tubular drillstring to the drill bit, where the mud leaves the drillstring through jetting ports and returns to the surface via the annulus between the drillstring and the bore wall. The mud lubricates and cools the drill bit, supports the walls of the unlined bore, and carries dislodged rock particles or drill cuttings away from the drill bit and to the surface.

In recent years the deviation, depth and length of wells has increased, and during drilling the mud may be circulated through a bore several kilometers long. Pressure losses are induced in the mud as it flows through the drillstring, downhole motors, jetting ports, and then passes back to the surface through the annulus and around stabilisers, centralisers and the like. This adds to natural friction associated pressure loss as experienced by any flowing fluid.

Similarly, the pressure of the drilling mud at the drill bit and, most importantly, around the hydrocarbon-bearing formation, has tended to rise as well depth, length and deviation increase; during circulation, the pressure across the formation is the sum of the hydrostatic pressure relating to the height and density of the column of mud above the formation, and the additional pressure required to overcome the flow resistance experienced as the mud returns to surface through the annulus. Of course the mud pressure at the bit must also be sufficient to ensure that the mud flowrate through the annulus maintains the entrainment of the drill cuttings.

The mud pressure in a bore is often expressed in terms of the effective circulating density (ECD), which is represented as the ratio between the weight or pressure of mud and the weight of a corresponding column of water. Thus, the hydrostatic pressure or ECD at a drill bit may be around I.05SG, whereas during circulation the mud pressure, or ECD, may be as high as I.55SG.

It is now the case that the ECD of the drilling mud at the lower end of the bore where the bore intersects the hydrocarbon-bearing formations is placing a limit on the length and depth of bores which may be drilled and reservoirs accessed. In addition to mechanical considerations, such as top drive torque ratings and drill pipe strength, the increase in ECD at the formation may reach a level where the mud damages the formation, and in particular reduces the productivity of the formation. During drilling it is usually preferred that the mud pressure is higher than the fluid pressure in the hydrocarbon-bearing formation, such that the formation fluid does not flow into the bore. However, if the pressure differential exceeds a certain level, known as the fracture gradient, the mud will fracture the formation and begin to flow into the formation. In addition to loss of drilling fluid, fracturing also affects the production capabilities of a formation. Attempts have been made to minimise the effects of fracturing by injecting materials and compounds into bore to plug the pores in the formation. However, this increases drilling costs, is often of limited effectiveness, and tends to reduce the production capabilities of the formation.

High mud pressure also has a number of undesirable effects on drilling efficiency. In deviated bores the drillstring may lie in contact with the bore wall, and if the bore intersects a lower pressure formation the fluid pressure acting on the remainder of the string will tend to push the string against the bore wall, significantly increasing drag on the string; this may result in what is known as "differential sticking."

It has also been suggested that high mud pressure at the bit reduces drilling efficiency, and this problem has been addressed in U.S. Pat. Nos. 4,049,066 (Richey) and 4,744,426 (Reed), the disclosures of which are incorporated herein by reference. Both documents disclose the provision of pump or fan arrangements in the annulus rearwardly of the bit, driven by mud passing through the drillstring, which reduces mud pressure at the bit. It is suggested that the disclosed arrangements improve jetting and the uplift of cuttings.

Another method of reducing the mud pressure at the bit is to improve drillstring design to minimise pressure losses in the annulus, and U.S. Pat. No. 4,823,891 (Hommani et al) discloses a stabiliser configuration which aims to minimise annulus pressure losses, and thus allow a desired mud flow to be achieved with lower initial mud pressure.

It is also known to aerate drilling mud, for example by addition of nitrogen gas, however the apparatus by necessary to implement this procedure is relatively expensive, cuttings suspension is poor, and the circulation of two phase fluids is problematic. The presence of low density gas in the mud may also make it difficult to "kill" a well in the event of an uncontrolled influx of hydrocarbon fluids into the wellbore.

It is among the objects of embodiments of the present invention to obviate or alleviate these and other difficulties associated with drilling operations.

SUMMARY OF THE INVENTION

According to the present invention there is provided a drilling method in which a drill bit is mounted on a tubular drill string extending through a bore, the method comprising:

drilling a bore which extends through a formation containing fluid at a predetermined pressure;

circulating drilling fluid down through the drill string to exit the string at or adjacent the bit, and then upwards through an annulus between the string and bore wall; and adding energy to the drilling fluid in the annulus at a location above said formation such that the pressure of the drilling fluid above said location is higher than the pressure of the drilling fluid below said location and there is a predetermined differential between the pressure of the formation fluid and the pressure of the drilling fluid in communication with the formation.

The invention also relates to apparatus for use in implementing this method.

The method of the present invention allows the pressure of the drilling fluid in communication with the formation, typically a hydrocarbon-bearing formation, to be maintained at a relatively low level, even in relatively deep or highly deviated bores, while the pressure in the drilling fluid above the formation may be maintained at a higher level to facilitate drilling fluid circulation and cuttings entrainment.

The differential between the drilling fluid pressure and the formation fluid pressure, which is likely to have been determined by earlier surveys, may be selected such that the drilling fluid pressure is high enough to prevent the formation fluid from flowing into the bore, but is not so high as to fracture or otherwise damage the formation. In certain embodiments, the pressure differential may be varied during a drilling operation to accommodate different conditions, for example the initial pressure differential may be controlled to assist in formation of a suitable filter cake. Alternatively, the drilling fluid pressure may be selected to be lower than the formation fluid pressure, that is the invention may be utilised to carry out "underbalance" drilling; in this case the returning drilling fluid may carry formation fluid, which may be separated from the drilling fluid at the surface.

Preferably, energy is added to the drilling fluid by at least one pump or fan arrangement. Most preferably, the pump is driven by the fluid flowing down through the drillstring, such as in the arrangements disclosed in U.S. Pat. Nos. 4,049,066 and 4,744,426. Fluid driven downhole pumps are also produced by Weir Pumps Limited of Cathcart, Glasgow, United Kingdom. The preferred pump form utilises a turbine drive, that is the fluid is directed through nozzles onto turbine blades which are rotated to drive a suitable impeller acting on the fluid in the annulus. Such a turbine drive is available, under the TurboMac trade mark, from Rotech of Aberdeen, United Kingdom. When using the preferred pump form the initial pump pressure at the surface will be relatively high, as energy is taken from the fluid, as it flows down through the string, to drive the pump. Alternatively, in other embodiments it may be possible for the pump to be driven by a downhole motor, to be electrically powered, or indeed driven by any suitable means, such as from the rotation of the drillstring.

Energy may be added to the drilling fluid in the annulus at a location adjacent the drill bit, but is more likely to be added at a location spaced from the drill bit, to allow the bore to be drilled through the formation and still ensure that the higher pressure fluid above said location is spaced from the formation.

In one embodiment of the invention, a portion of the circulating drilling fluid may be permitted to flow directly from the drillstring bore to the annulus above the formation, and such diversion of flow may be particularly useful in boreholes of varying diameter, the changes in diameter typically being step increases in bore diameter. When the bore diameter increases, drilling fluid flow speed in the annulus will normally decrease, and the additional volume of fluid flowing directly from the drillstring bore into the annulus assists in maintaining flow speed and cuttings entrainment. This may be achieved by provision of one or more bypass subs in the string. The bypass subs may be selectively operable to provide fluid bypass only when considered necessary or desirable.

The drillstring may also be provided with means for agitating cuttings in the annulus, such as the flails disclosed in U.S. Pat. No. 5,651,420 (Tibbets et al.), the disclosure of which is incorporated herein by reference. Tibbets, et al. propose mounting flails on elements of the drillstring, which flails are actuated by the rotation of the string or the flow of drilling fluid around the flails. Most preferably however, the agitating means are mounted on a body which is rotatable relative to the string. The body is preferably driven to rotate by drive means actuated by the flow of drilling fluid through the string, but may be driven by other means. This feature may be provided in combination with or separately of the main aspect of the invention.

BRIEF DESCRIPTION OF THE DRAWINGS

So that the manner in which the above recited features of the present invention can be understood in detail, a more particular description of the invention, briefly summarized above, may be had by reference to embodiments, some of which are illustrated in the appended drawings. It is to be noted, however, that the appended drawings illustrate only typical embodiments of this invention and are therefore not to be considered limiting of its scope, for the invention may admit to other equally effective embodiments.

These and other aspects of the present invention will now be described, by way of example only, with reference to the accompanying drawings, in which.

DETAILED DESCRIPTION OF THE PREFERRED EMBODIMENT

Figure 1:
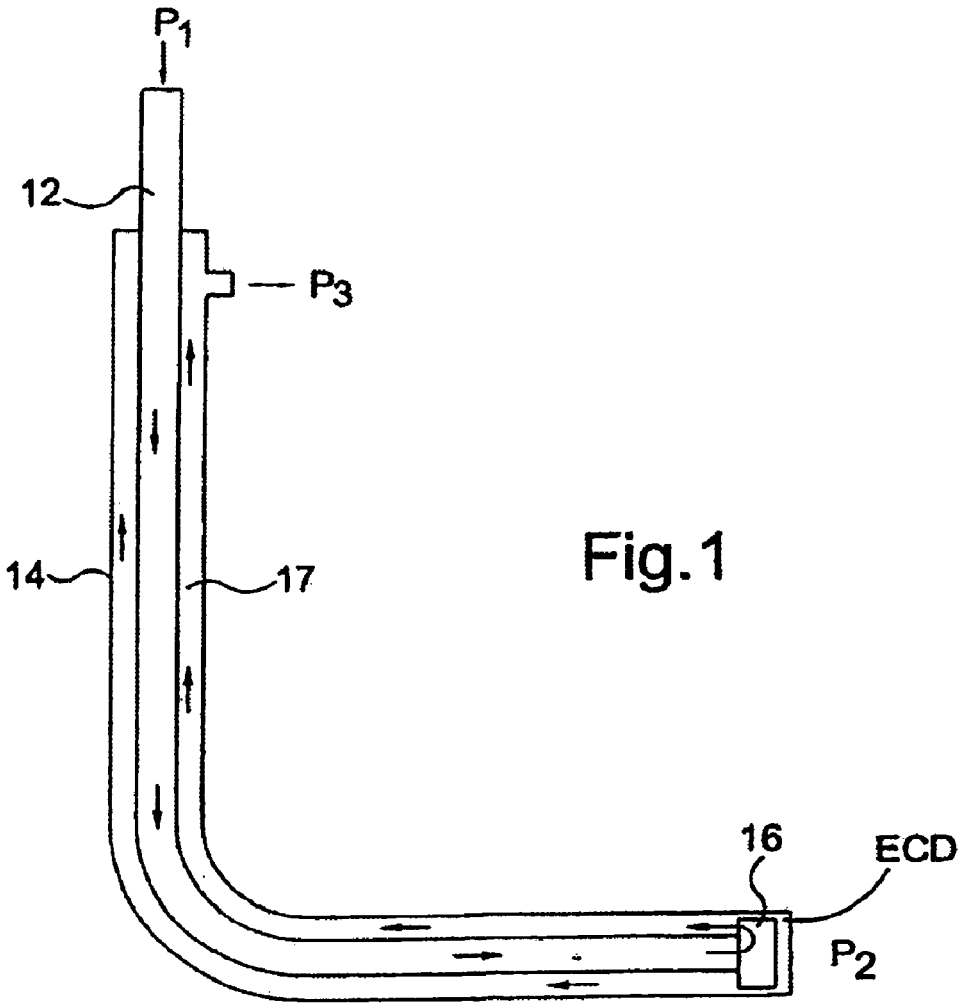
FIG. 1 is a schematic illustration of a conventional wellbore drilling operation.

Reference is first made to FIG. 1 of the drawings, which illustrates a conventional drilling operation. A rotating drill string 12 extends through a borehole 14, and drilling mud is pumped from the surface down the drill string 12, to exit the string via jetting ports (not shown) in a drill bit 16, and returns to the surface via the annulus 17 between the string 14 and the bore hole wall.

Figure 2:
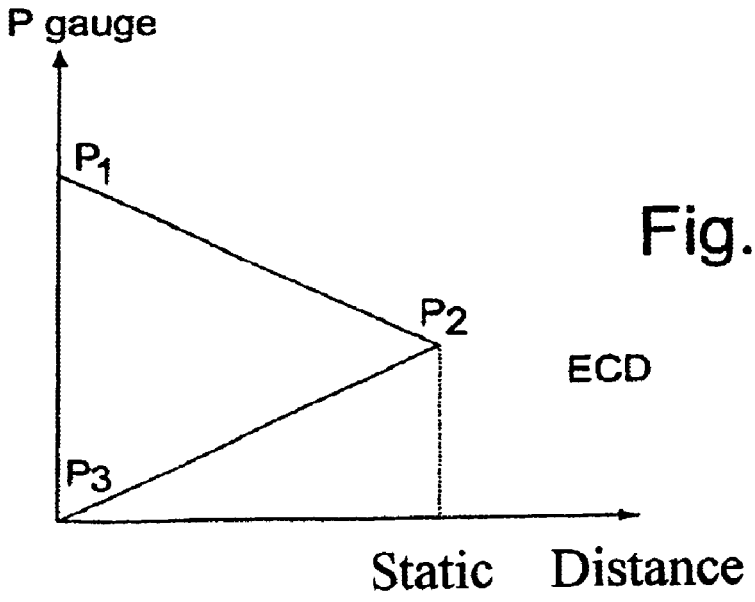
FIG. 2 is a graph illustrating the pressure of circulating drilling mud at various points in the wellbore of FIG. 1.

Reference is now also made to FIG. 2 of the drawings, which is a sketch graph of the pressure of the drilling mud at various points in the wellbore 14 as illustrated in FIG. 1. The mud enters the drillstring at the surface at a relatively high pressure $P_1$, and emerges from the bit 16 at a lower pressure $P_2$ reflecting the pressure losses resulting from the passage of the mud through the string 12 and bit 16. The drilling mud returns to the surface via the annulus 17 and reaches surface at close to atmospheric pressure $P_3$.

Figure 3:
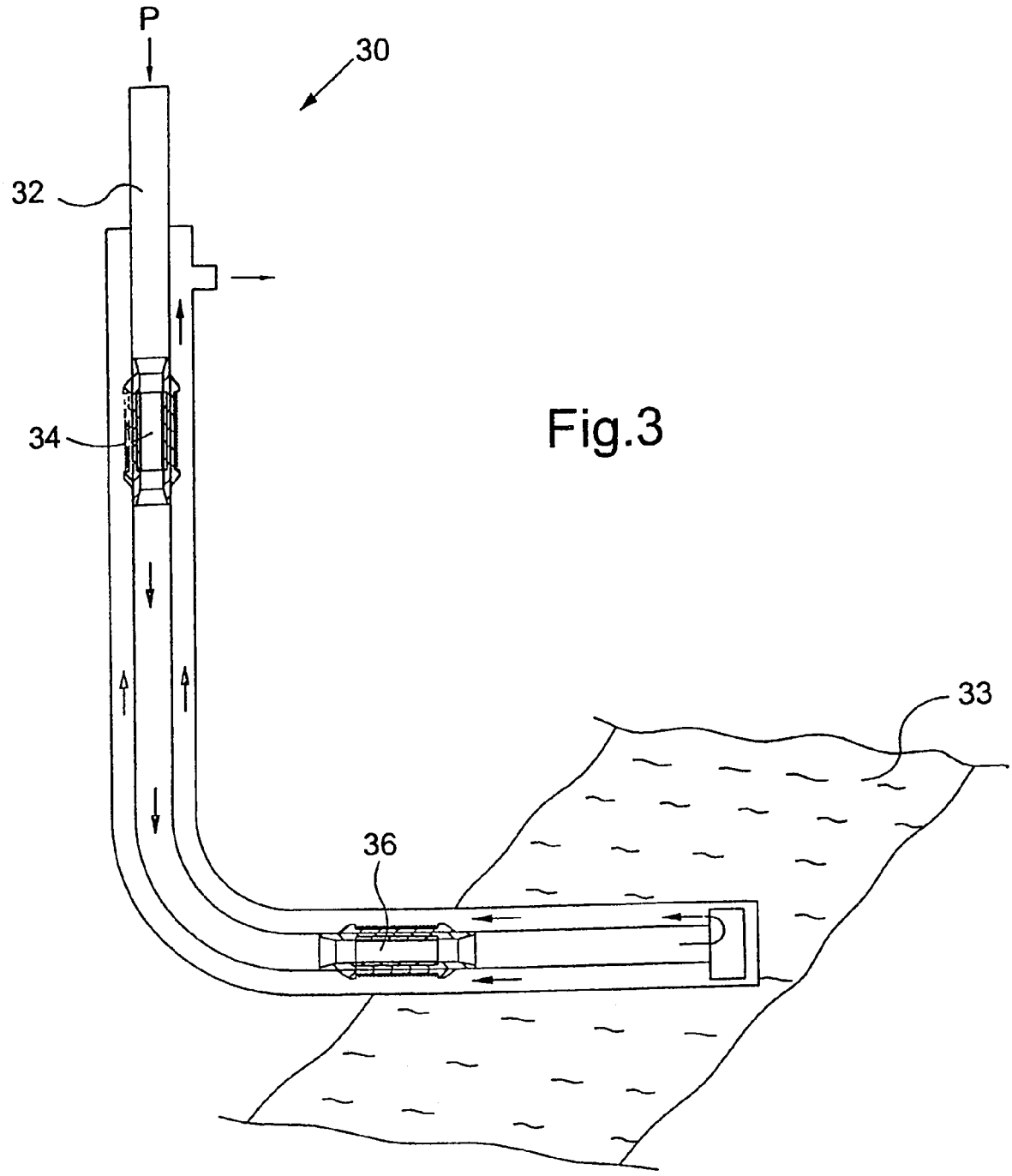
FIG. 3 is a schematic illustration of a wellbore drilling operation according to an embodiment of the present invention.

FIG. 3 of the drawings illustrates a drilling operation in accordance with an embodiment of a first aspect of the present invention, a drill string 32 being shown located in a drilled bore intersecting a hydrocarbon-bearing formation 33.

Mounted on the drillstring 32 are two pump assemblies 34, 36 which serve to assist the flow of drilling mud through the annulus, and to allow a reduction in the ECD at various points in the wellbore, with the lowermost pump 36 being located above the formation 33. One of the pumps 34 is shown schematically in FIG. 4 of the drawings, and comprises a turbine motor section 46, such as is available under the TurboMac trade mark from Rotech of Aberdeen, United Kingdom, and a pump section 48. The motor section 46 is arranged to be driven by the flow of mud downhole through the string bore 44, rotation of the motor section 46 being transferred to the pump section 48, which includes vanes 49 extending into the annulus 50. The pump vanes are arranged to add energy to the mud in the annulus 50, increasing the mud pressure as it passes across the pump section 48.

Figure 4:
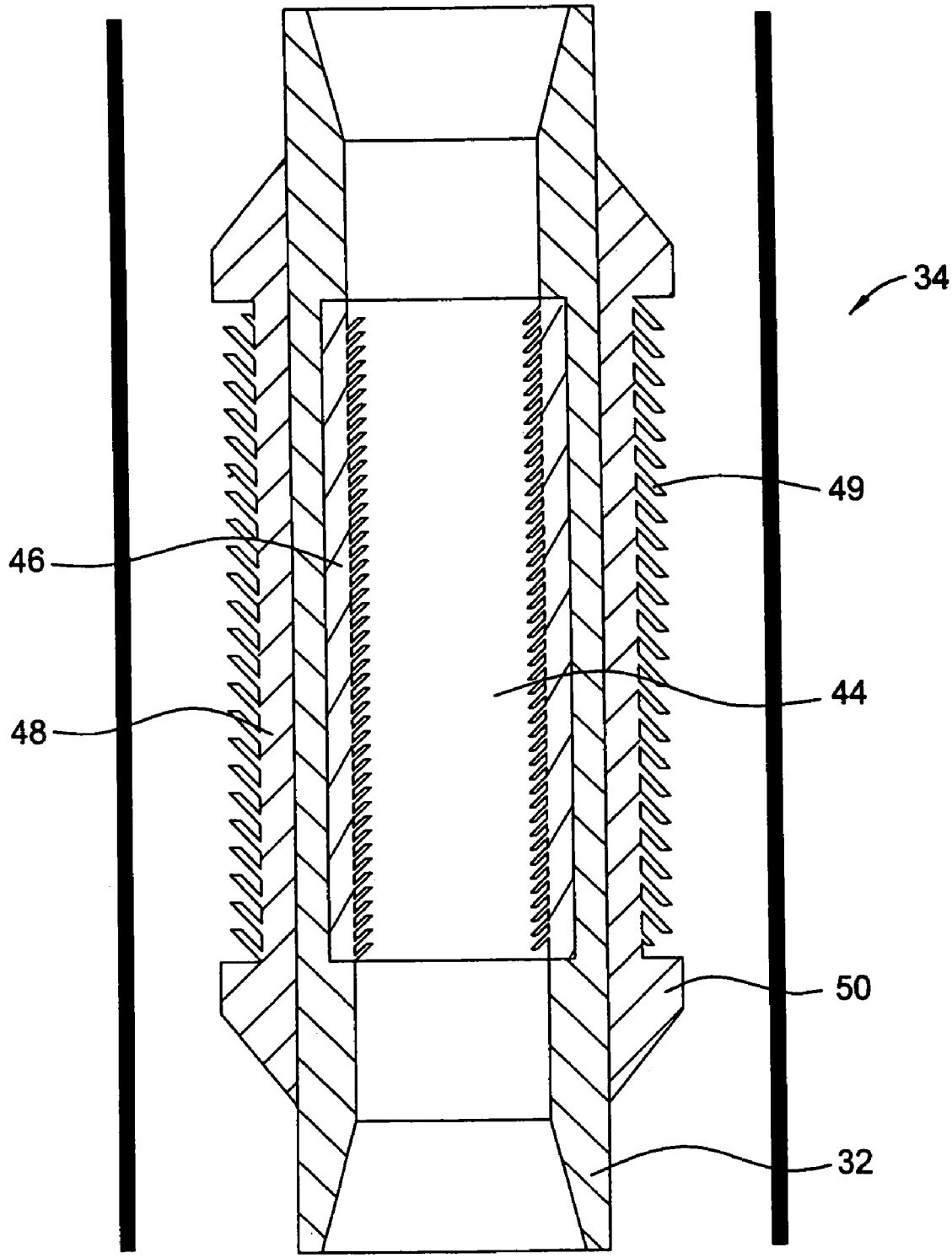
FIG. 4 is a enlarged sectional view of a pump arrangement of FIG. 3.
Figure 5:
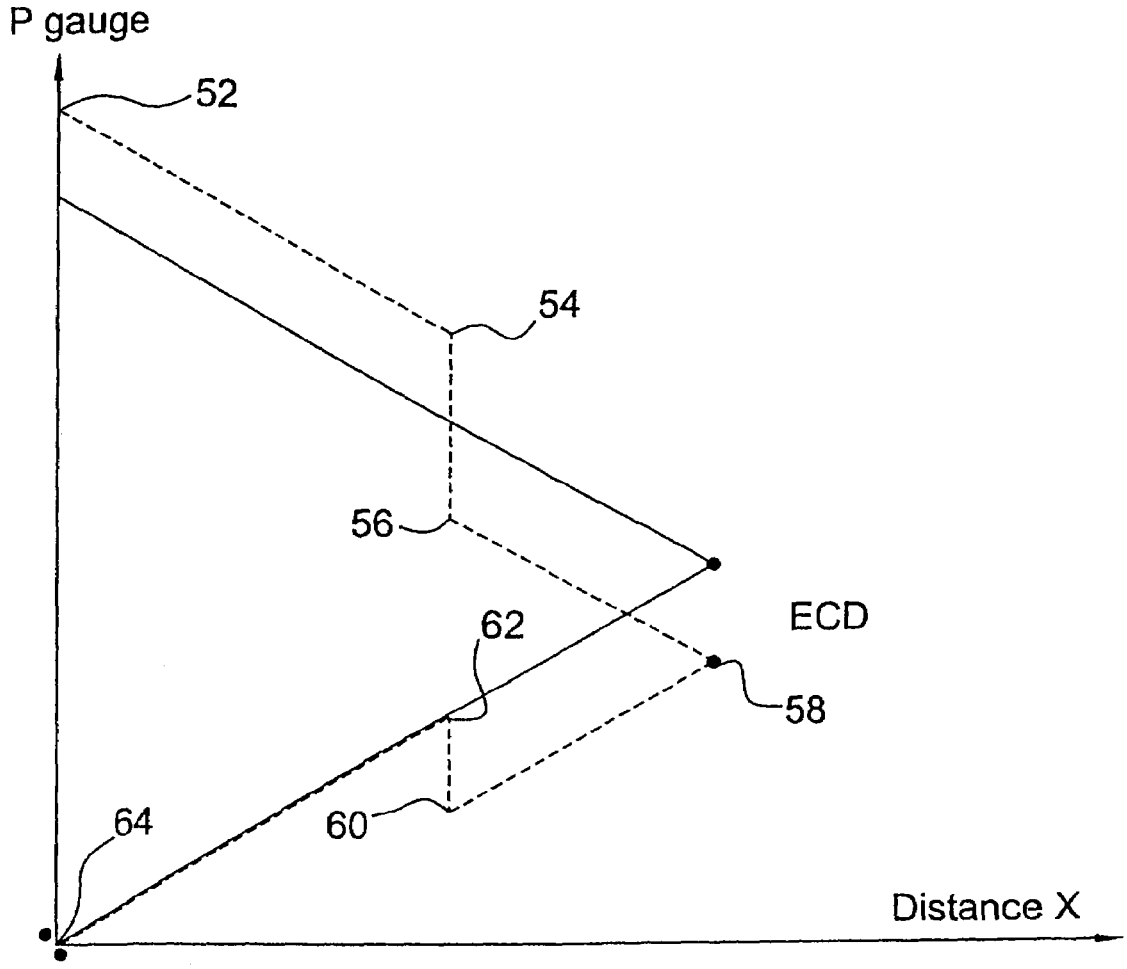
FIG. 5 is a graph illustrating the pressure of circulating drilling mud at various points in the wellbore in a drilling operation according to an embodiment of the present invention.
Figure 4:
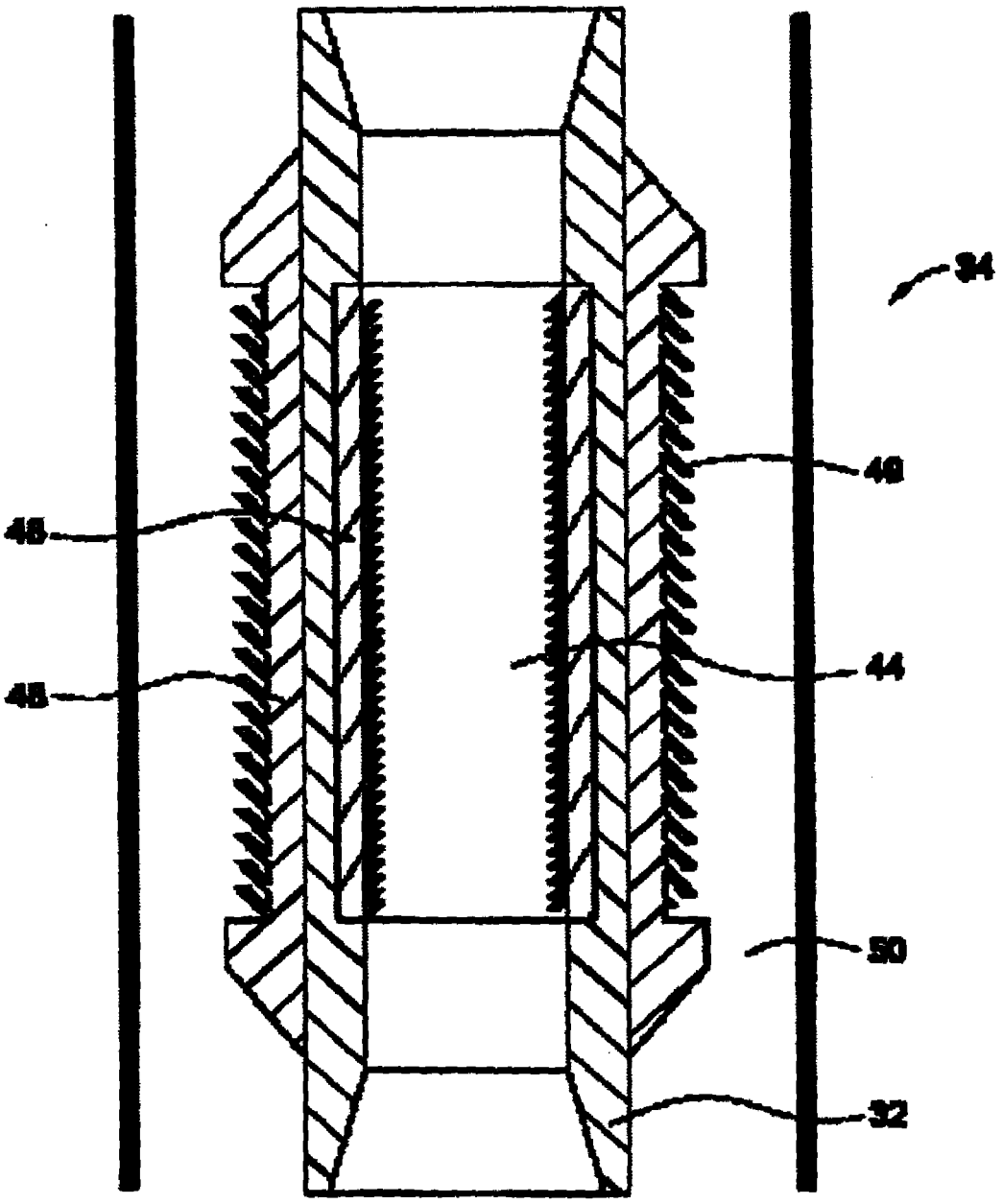

FIG. 5 is a sketch graph of the pressure of circulating drilling mud in a drilling operation utilizing a single pump assembly 36 as described in FIG. 4, the pump 36 being located in the string such that the pump 36 remains above the hydrocarbon-bearing formation during the drilling operation. The solid line is the same as that of the graph of FIG. 2, and illustrates the circulating mud pressure profile in a comparable conventional wellbore drilling operation. The dashed line illustrates the effect on the circulating mud pressure resulting from the provision of a pump assembly 36 in the drillstring 32, as will be described. At the surface, the mud pressure must be higher than conventional; shown by point 52, and then drops gradually due to pressure losses to point 54, where the fluid in the drill string 32 passes through the pump turbine motor section 46 and transfers energy to the fluid in the annulus 50, as reflected by the rapid loss of pressure, to point 56. As the mud emerges from the drillstring 32 at the drill bit 16, it is apparent that the pressure or ECD of the mud, at point 58, is lower than would be the case in a conventional drilling operation, despite the higher initial mud pressure 52. As the return mud passes up through the annulus 50 it loses pressure gradually until reaching the pump 36, at point 60, whereupon it receives an energy input in the form of a pressure boost 62, to ensure that the mud will flow to the surface with the cuttings entrained in the mud flow. As with a conventional drilling operation, the mud exits the string 32 at close to atmospheric pressure, at point 64.

The pressure of the fluid in the formation 33 will have been determined previously by surveys, and the location of the pump 36 and the mud pressure between the points 58, 60 are selected such that there is a predetermined pressure differential between the drilling fluid pressure and the formation fluid pressure. In most circumstances, the drilling fluid pressure will be selected to be higher than the formation fluid pressure, to prevent or minimise the flow of formation fluid into the bore, but not so high to cause formation damage, that is at least below the fracture gradient.

Thus, it may be seen that the present invention provides a means whereby the ECD in the section of wellbore intersecting the hydrocarbon-bearing formation may be effectively reduced or controlled to provide a predetermined pressure differential between the drilling fluid and the formation fluid without the need to reduce the mud pressure elsewhere in the wellbore or impact on cuttings entrainment. This ability to reduce and control the ECD of the drilling mud in communication with the hydrocarbon-bearing formation allows drilling of deeper and longer wells while reducing or obviating the occurrence of formation damage, and will reduce or obviate the need for formation pore plugging materials, thus reducing drilling costs and improving formation production.

It will be understood that the foregoing description is for illustrative purposes only, and that various modifications and improvements may be made to the apparatus and method herein described, without departing from the scope of the invention. For example, the pump assemblies may be electrically or hydraulically powered, and may only be actuated when the pressure of the drilling mud in communication with the formation rises above a predetermined pressure; a predetermined detected pressure may activate a fluid bypass causing fluid to be directed to drive an appropriate pump assembly.

While the foregoing is directed to embodiments of the present invention, other and further embodiments of the invention may be devised without departing from the basic scope thereof, and the scope thereof is determined by the claims that follow.

What is claimed is:

1. A method of adjusting a pressure of a circulating fluid in a wellbore relative to a pressure in a formation of interest adjacent the wellbore, comprising:

drilling in the formation of interest;

circulating fluid in annulus between a drill string and a wall of the wellbore; and adding energy to the circulating fluid in the annulus at one or more predetermined locations above the formation of interest, to increase a force asserted against a bottom surface of the wellbore by the drill string.

2. The method of claim 1, wherein the pressure of the circulating fluid above at least one of the one or more predetermined locations is higher than pressure of circulating fluid in communication with the formation of interest.

3. The method of claim 1, wherein pressure of circulation fluid in communication with the formation is lower than the pressure in the formation of interest.

4. The method of claim 1, wherein the formation is a hydrocarbon-bearing formation.

5. The method of claim 1, wherein energy is added to the circulating fluid by one or more pump arrangements.

6. The method of claim 5, wherein at least one of the one or more pump arrangements is driven by a fluid flowing through the drill string.

7. The method of claim 5, wherein at least one of the one or more pump arrangements is electrically powered.

8. The method of claim 5, wherein at least one of the one or more pump arrangements is driven by rotation of the drill string.

9. The method of claim 1, further comprising flowing at least a portion of the circulating fluid directly from the drill string to the annulus.

10. The method of claim 1, wherein pressure of the circulating fluid in communication with the formation is lower than hydrostatic pressure.

11. A method of redistributing forces within a wellbore, comprising:

drilling in a formation of interest;

circulating fluid in an annulus between a drill string and a wall of the wellbore; and adding energy to the circulating fluid in the annulus at one or more predetermined locations above the formation to decrease a force asserted on the formation of interest by of the circulating fluid in the annulus.

12. The method of claim 11, wherein the formation is a hydrocarbon-bearing formation.

13. The method of claim 11, wherein energy is added to the circulating fluid by one or more pump arrangements.

14. The method of claim 13, wherein at least one of the one or more pump arrangements is driven by a fluid flowing through the drill string.

15. The method of claim 13, wherein at least one of the one or more pump arrangements is electrically powered.

16. The method of claim 13, wherein at least one of the one or more pump arrangements is driven by rotation of the drill string.

17. The method of claim 11, further comprising flowing at least a portion of the circulating fluid directly from the drill string to the annulus.

18. An apparatus for redistributing forces within a wellbore, comprising:

a drill string for extending through a wellbore;

a drill bit mounted on the drill string for drilling through a formation containing fluid;

a pump for circulating drilling fluid through the drill string to exit the drill string at or adjacent the drill bit and enter an annulus between the drill string and a wall of the wellbore, and then continuously through the annulus; and a fluid motive assembly for adding energy to the drilling fluid in the annulus above the formation to increase a force asserted against a bottom surface of the wellbore by the drill string.

19. The method apparatus of claim 18, wherein the formation is a hydrocarbon-bearing formation.

20. A method of adjusting pressure of a circulating fluid in a wellbore, comprising:

pumping a fluid into an inner diameter of a drill string and out proximate an end of the drill string;

flowing the fluid in an annulus between an outer diameter of the drill string and a wall of the wellbore; and extracting energy from the fluid in the drill string and transferring at least a portion of the energy through a pressure-bearing boundary of the drill string to the fluid flowing in the annulus.

21. The method of claim 20, wherein extracting energy from the fluid in the drill string and transferring at least a portion of the energy through a pressure-bearing boundary of the drill string to the fluid flowing in the annulus increases a force of the drill string asserted against a bottom surface of the wellbore.

22. The method of claim 20, wherein extracting energy from the fluid in the drill string and transferring at least a portion of the energy through a pressure-bearing boundary of the drill string to the fluid flowing in the annulus decreases a force asserted on the formation of interest by the circulating fluid in the annulus.

* * * * *

UNITED STATES PATENT AND TRADEMARK OFFICE

CERTIFICATE OF CORRECTION

PATENT NO. : 6,968,911 B2
APPLICATION NO. : 10/822530
DATED : November 29, 2005
INVENTOR(S) : Peter Barnes Moyes It is certified that error appears in the above-identified patent and that said Letters Patent is hereby corrected as shown below:

On Title Page, Col. 1
In Field (56) References Cited:

Please insert the following:

5,434,426 A 8/1985 Hooper

Column 6, Claim 1, Line 26: Insert --an-- between "in" and "annulus"

Column 6, Claim 2, Line 32: Delete "the" between "wherein" and "pressure"

Column 6, Claim 3, Line 36: Change "circulation" to --circulating--

Column 6, Claim 11, Line 65: Delete "of" before "the"

In the Drawings:

Replace fig. 4 with attached fig. 4 sheet.

Signed and Sealed this

Thirty-first Day of October, 2006

JON W. DUDAS
*Director of the United States Patent and Trademark Office*